US007321678B2

(12) United States Patent
Itako

(10) Patent No.: US 7,321,678 B2
(45) Date of Patent: Jan. 22, 2008

(54) BANKNOTE IDENTIFYING MACHINE AND BANKNOTE IDENTIFYING METHOD

(75) Inventor: Eiji Itako, Sakado (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 865 days.

(21) Appl. No.: 10/470,745

(22) PCT Filed: Nov. 11, 2002

(86) PCT No.: PCT/JP02/11724

§ 371 (c)(1),
(2), (4) Date: Aug. 11, 2003

(87) PCT Pub. No.: WO03/050772

PCT Pub. Date: Jun. 19, 2003

(65) Prior Publication Data

US 2004/0151359 A1 Aug. 5, 2004

(30) Foreign Application Priority Data

Dec. 13, 2001 (JP) ..... 2001-380106

(51) Int. Cl.
*G06K 9/00* (2006.01)

(52) U.S. Cl. ..... 382/137; 382/138; 382/139; 382/140

(58) Field of Classification Search ..... 382/137, 382/138, 139, 140
See application file for complete search history.

(56) References Cited

U.S. PATENT DOCUMENTS

| | | | | |
|---|---|---|---|---|
| 4,296,326 | A | 10/1981 | Haslop et al. | |
| 4,881,268 | A * | 11/1989 | Uchida et al. | 382/135 |
| 5,295,196 | A * | 3/1994 | Raterman et al. | 382/135 |
| 5,845,008 | A * | 12/1998 | Katoh et al. | 382/217 |
| 5,923,413 | A | 7/1999 | Laskowski | |

FOREIGN PATENT DOCUMENTS

| | | |
|---|---|---|
| JP | 61-32460 | 9/1986 |
| JP | 10-162194 | 6/1998 |
| JP | 2000-306136 | 11/2000 |

* cited by examiner

*Primary Examiner*—Bhavesh M Mehta
*Assistant Examiner*—Jonathan Schaffer
(74) *Attorney, Agent, or Firm*—Kratz, Quintos & Hanson, LLP

(57) ABSTRACT

A banknote identifying machine and method for testing a banknote for genuineness stably without being affected by a sensor or contamination on the banknote. Transmission photosensors 61 are moved over a banknote to be tested to scan the banknote with a light beam along reading lines L to obtain patterns of an amount of transmitted light through the banknote (FIGS. 3(*b*) and 3(*c*)). Patterns (1*a*, 1*b*) of an amount of transmitted light corresponding to watermark portions are evaluated with maximum values (11, 12) of patterns of an amount of transmitted light corresponding to ordinary design portions other than the watermarks to determine whether or not there is any watermark in the banknote and to authenticate it.

9 Claims, 6 Drawing Sheets

BANKNOTE IDENTIFYING MACHINE AND BANKNOTE IDENTIFYING METHOD

TECHNICAL FIELD

The present invention relates to a banknote identifying machine and banknote identifying method, and more particularly to a banknote identifying machine and banknote identifying method, which enable accurate determination of the authenticity of banknote without depending on a condition of the banknote.

BACKGROUND ART

Generally, banknote is identified its denomination and authenticity by magnetically or optically extracting the features of the banknote, which is inserted by a user, by a magnetic sensor or an optical sensor.

For extraction of the optical characteristics of banknote by a photosensor, a design, dimensions, direction and the like of banknote are extracted by a transmission photosensor or a reflection photosensor to obtain its image pattern, which is then compared with a reference pattern of authentic banknote of each denomination to determine a denomination and authenticity of the inserted banknote.

Especially, the determination of authenticity of banknote by the transmission photosensor was performed by moving the banknote between a light-emitting element and a light-receiving element, which are disposed with a prescribed distance between them, to detect a contrast pattern of the transmitted light and comparing the detected contrast pattern with a previously stored reference contrast pattern of authentic banknote.

But, banknote includes just issued new ones and those contaminated, damaged or worn out in circulation, and even the same banknote is largely variable in optical characteristics, magnetic characteristics and the like which are factors used for identification of the banknote. Thus, the above-described existing method had difficulties in determining the authenticity.

DISCLOSURE OF THE INVENTION

Therefore, it is an object of the present invention to provide a banknote identifying machine and banknote identifying method which can stably determine the authenticity of banknote without being affected by a sensor or contamination on the banknote.

In order to achieve the above object, the banknote identifying machine of the present invention is a banknote identifying machine comprising pattern detecting means which moves relative to banknote to scan it and irradiates light to the banknote to detect patterns of amount of light transmitted through the banknote; and judging means which evaluates a pattern of the amount of transmitted light detected through a watermark portion of the banknote by the pattern detecting means by a maximum value of a pattern of the amount of transmitted light detected through ordinary design portions other than the watermark portion and determines the watermark of the banknote according to the evaluated value.

The banknote identifying machine of the present invention is a banknote identifying machine, comprising: a transmission photosensor which moves relative to banknote to scan it and radiates light to the banknote to detect a pattern of an amount of transmitted light through the banknote; data storage means which stores data output from the transmission photosensor by allocating serial addresses to the data; storage location address storage means which previously stores addresses of storage regions of the data storage means in which data output according to a watermark portion of the banknote is to be stored; and authenticity judging means which evaluates data stored in the storage regions of the storage means designated by the addresses stored in the storage location address storage means by data on a maximum value among data corresponding to portions other than the watermark and determines the authenticity of the banknote according to the evaluation.

And, the present invention relates to the above banknote identifying machine which further comprises determination means which determines a denomination of the banknote, wherein: the storage location address storage means previously stores the addresses of storage regions of the data storage means, in which the data output according to the watermark portion of the banknote is to be stored, according to the denomination of the banknote; and the authenticity judging means obtains addresses, which are stored in association with the denomination determined by the determination means, from the storage location address storage means, evaluates data, which is stored in the storage region of the data storage means designated by the obtained addresses, by the data on the maximum value among the data corresponding to the portions other than the watermark and determines the authenticity of the banknote according to the evaluation.

The present invention also relates to the above banknote identifying machine which further comprises determination means, which determines an inserted direction of the banknote, wherein: the storage location address storage means previously stores the addresses of storage regions of the data storage means, in which data output according to the watermark portion of the banknote is to be stored, according to the inserted direction of the banknote; and the authenticity judging means obtains addresses, which are stored in association with the inserted direction determined by the determination means, from the storage location address storage means, evaluates data, which is stored in the storage region of the data storage means designated by the obtained addresses, by the data on the maximum value among the data corresponding to the portions other than the watermark and determines the authenticity of the banknote according to the evaluation.

The present invention also relates to the above banknote identifying machine which further comprises determination means which determines a denomination and an inserted direction of the banknote, wherein: the storage location address storage means previously stores the addresses of storage regions of the data storage means, in which data output according to the watermark portion of the banknote is to be stored, according to the denomination and the inserted direction of the banknote; and the authenticity judging means obtains addresses, which are stored in association with the denomination and the inserted direction determined by the determination means, from the storage location address storage means, evaluates data, which is stored in the storage region of the data storage means designated by the obtained addresses, by the data on the maximum value among the data corresponding to the portions other than the watermark and determines the authenticity of the banknote according to the evaluation.

And, the present invention relates to the above banknote identifying machine, wherein the authenticity judging means determines the presence or not of the watermark on the banknote according to a difference between data on the maximum value output according to the watermark portion and data on the maximum value output according to the portions other than the watermark.

The present invention relates to the above banknote identifying machine, wherein the authenticity judging means counts a quantity of data which is output according to the watermark portion and larger than the data on the maximum value output according to the portions other than the watermark and determines the presence or not of a watermark on the banknote according to the counted quantity.

The present invention relates to the above banknote identifying machine, wherein the authenticity judging means determines the presence or not of the watermark on the banknote according to a total value of differences between data which is output according to the watermark portion and larger than data on the maximum value output according to the portions other than the watermark and data on the maximum value output according to the portions other than the watermark.

And, a banknote identifying method according to the present invention comprises scanning banknote by moving relative to the banknote, detecting a pattern of an amount of transmitted light through the banknote by irradiating light to the banknote, evaluating the pattern of the amount of transmitted light, which is detected from a watermark portion of the banknote, by a maximum value of the pattern of the amount of transmitted light, which is detected from an ordinary design portion other than the watermark, and determining the watermark of the banknote according to the evaluated value.

According to the present invention, the amount of transmitted light from the watermark of the banknote is evaluated by the amount of transmitted light from the portions other than the watermark. Specifically, the watermark portion and the other portions are subjected to relative comparison, so that the banknote can be stably determined its authenticity without being affected by a sensor or contamination on the banknote, and because the authenticity is determined based on the quality (thickness) of the banknote, the accuracy of determining counterfeit banknote which is virtually distinguishable from the real one can be improved.

BEST MODE FOR CARRYING OUT THE INVENTION

An embodiment of the banknote identifying machine and banknote identifying method according to the present invention will be described in detail with reference to the accompanying drawings.

Figure 1:
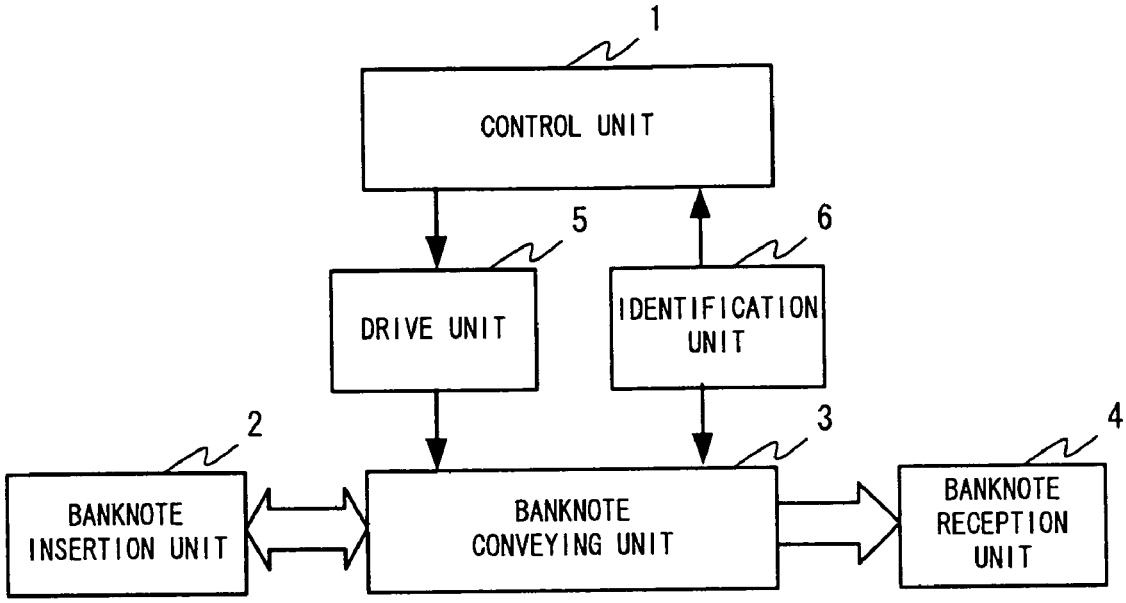
FIG. 1 is a block diagram schematically showing the structure of a banknote identifying machine according to the present invention.

FIG. 1 is a block diagram schematically showing a structure of the banknote identifying machine.

As shown in FIG. 1, the banknote identifying machine is provided with a control unit 1, a banknote insertion unit 2, a banknote conveying unit 3, a banknote reception unit 4, a drive unit 5, and an identification unit 6.

Banknote inserted through the banknote insertion unit 2 is conveyed by the banknote conveying unit 3 which is driven by the drive unit 5. The banknote being conveyed by the banknote conveying unit 3 is determined its denomination and authenticity by the identification unit 6. The banknote which is judged as authentic is accepted by the banknote reception unit 4 as the drive unit 5 is controlled by the control unit 1.

Figure 2:
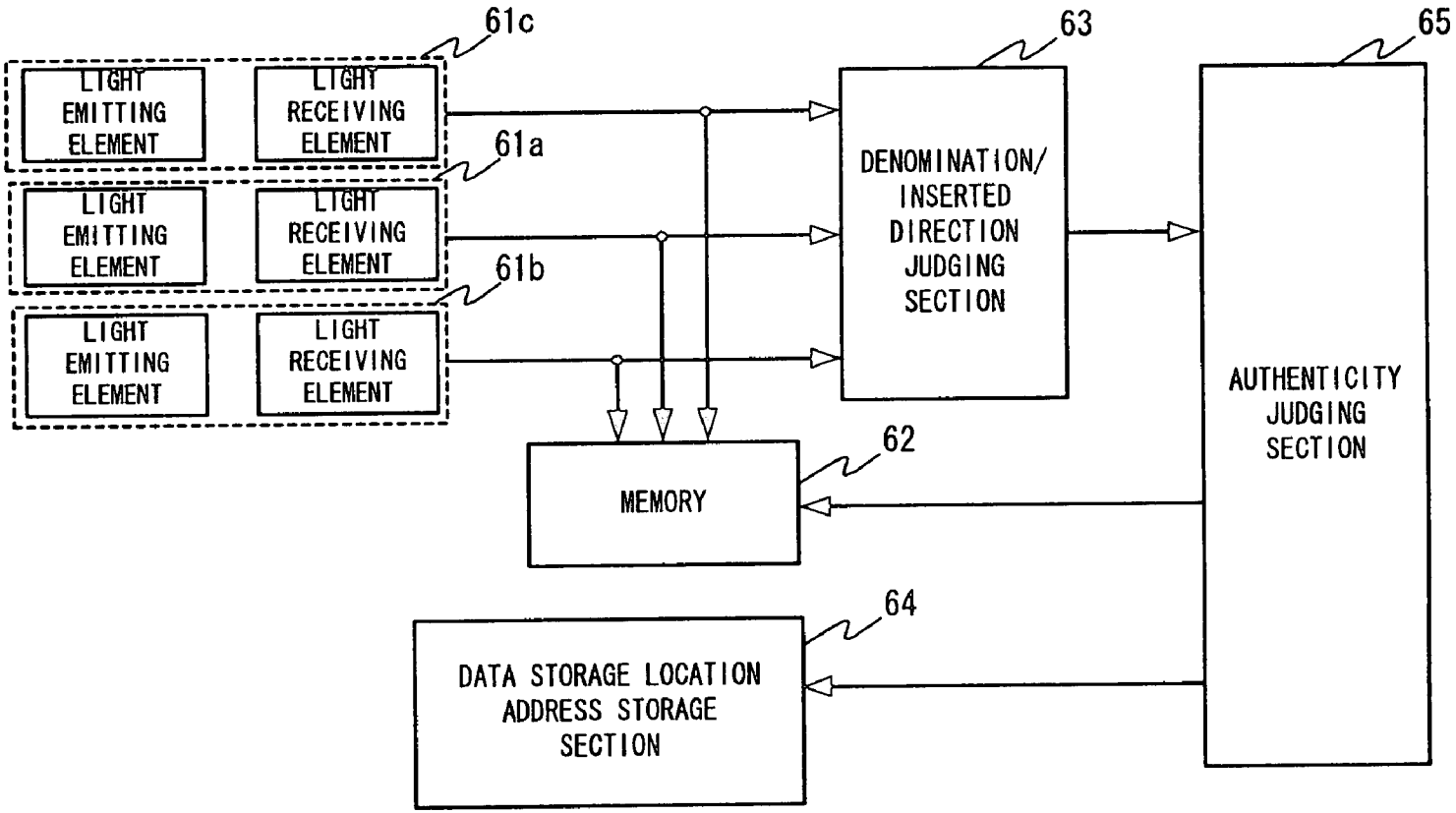
FIG. 2 is a block diagram showing in detail the structure of the identification unit shown in FIG. 1.

FIG. 2 is a block diagram schematically showing the structure of the identification unit 6.

In FIG. 2, the identification unit 6 is provided with transmission photosensors 61 (61*a* to 61*c*), a memory 62, a denomination/inserted direction judging section 63, a data storage location address storage section 64, and an authenticity judging section 65.

The transmission photosensors 61*a* to 61*c* each comprise a pair of light-emitting element and light-receiving element, which is disposed to have the banknote conveying unit 3 between the pair and over each prescribed scanning line which passes over a watermark portion of banknote to be identified, irradiate light to the banknote being conveyed through the banknote conveying unit 3, and output an electric signal according to an amount of light passing through the banknote. The transmission photosensors 61 may also use infrared rays, ultraviolet rays or a visible ray.

The memory 62 sequentially stores, in a prescribed storage region thereof, a signal level of the electric signal output from each of the respective photosensors 61 at a prescribed time interval, allocates serial addresses to them, and temporarily stores as pattern data on banknote 7 on each scanning line.

The denomination/inserted direction judging section 63 judges a type of banknote and its inserted direction according to output from the transmission photosensors 61 and other unshown sensors (e.g., a magnetic sensor).

Based on reference data on genuine banknote, the data storage location address storage section 64 previously stores addresses of the start-point and end-point of a storage region, in which read data on a prescribed region including watermark portions of banknote is stored and addresses of the start-point and end-point of a storage region, in which read data on a prescribed region including an ordinary design portion other than the watermark is stored, as a watermark region storage location address and an ordinary design region storage location address for a denomination and inserted direction, respectively.

According to the denomination and inserted direction determined by the denomination/inserted direction judging section 63, the authenticity judging section 65 reads the watermark region storage location address and ordinary design region storage location address from the data storage location address storage section 64 and extracts pattern data corresponding to the watermark region and pattern data corresponding to the ordinary design region from the memory 62 based on the read watermark region storage location address and the ordinary design region storage location address. Then, the authenticity judging section 65 compares the above two pattern data by the method to be described later to determine whether the inserted banknote has a watermark, thereby determining the authenticity of the banknote.

Figure 3A:
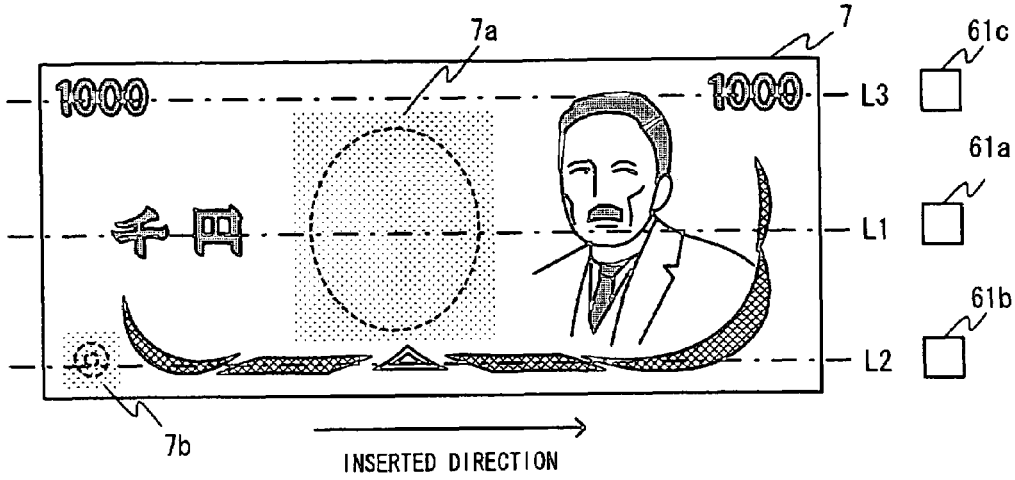
FIG. 3(*a*) to FIG. 3(*c*) are diagrams showing an example of banknote and its transmitted light patterns.
Figure 3B:
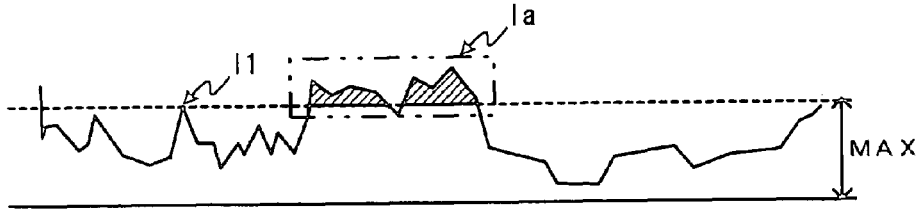
Figure 3C:
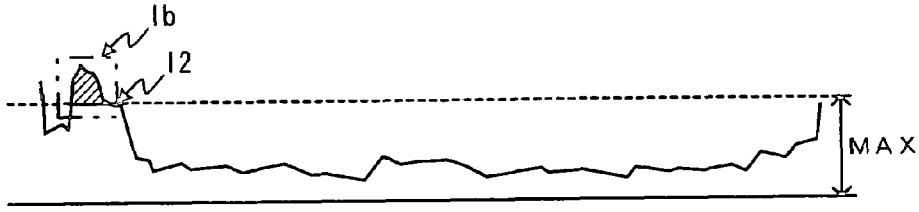

FIG. 3(*a*) is a plan view schematically showing banknote.

It is seen in FIG. 3(*a*) that the banknote 7 has watermarks at two positions, namely at the center and at the lower left corner (indicated by dotted lines). In this example, a scanning line L1 (indicated by a broken chain line) tracked by the photosensor 61*a* crosses a region 7*a* including a watermark portion at the center of the banknote, and a scanning line L2 (indicated by a broken chain line) tracked by the photosensor 61*b* crosses a region 7*b* including a watermark portion for the blind at the lower left corner of the banknote. It is to be noted that a scanning line L3 (indicated by a broken chain line) tracked by the photosensor 61*c* may cross the region 7*b* including the watermark portion for the blind depending on the inserted direction of the banknote.

FIG. 3(*b*) shows data obtained by scanning the banknote 7 along the scanning line L1 by the photosensor 61*a*, and FIG. 3(*c*) shows a pattern of data obtained by scanning the banknote 7 along the scanning line L2 by the photosensor 61*b*. In FIG. 3(*b*) and FIG. 3(*c*), the vertical axis corresponds to an output signal level (light transmission level) of the individual photosensor 61, and the horizontal line corresponds to a scanning position (address of the memory 62) on the banknote 7 by the individual photo sensor.

Generally, the watermark portions on the banknote are thinner than the other portions where the ordinary design is formed. Therefore, the watermark portions have a relatively higher light transmission level than those of other portions as indicated by reference numeral 1*a* in FIG. 3*b* and reference numeral 1*b* in FIG. 3*c* (the regions indicated by a chain double-dashed line).

The banknote 7 of FIG. 3(*a*) is shown that its ordinary design portions have maximum transmission levels MAX at the portion indicated by reference numeral 11 in FIG. 3(*b*) and the portion indicated by reference numeral 12 in FIG. 3(*c*). The values of such maximum transmission levels MAX of the ordinary design portions are variable depending on various factors such as contamination on the banknote 7 as the whole, an error of the photosensors 61, a change with time or the like. Therefore, by evaluating the transmitted light levels of the regions 7*a* and 7*b* including the watermark portions with the use of the maximum transmission levels MAX of the ordinary design portions, it is possible to perform stable determination of the authenticity without being affected by the condition of banknote. The maximum transmission levels MAX of the ordinary design portions will be referred to as the reference transmission level MAX.

Then, the process of determining the authenticity of banknote by the authenticity judging section 65 will be described below.

Figure 4:
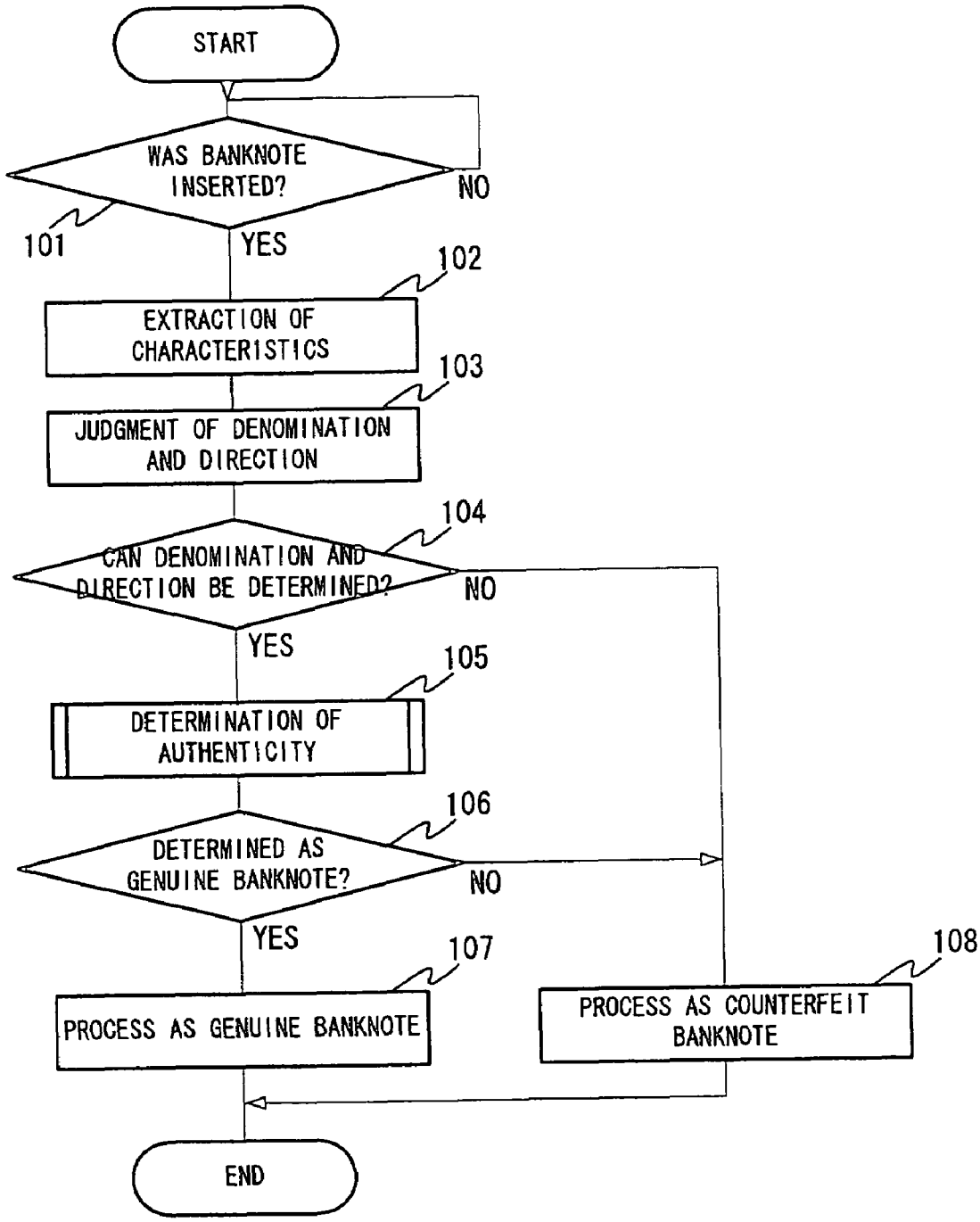
FIG. 4 is a flow chart illustrating an identifying process of banknote by the banknote identifying machine shown in FIG. 1.

FIG. 4 is a flow chart schematically showing a process from the insertion of banknote to the determination of authenticity of this embodiment.

When banknote is inserted through an unshown banknote insertion slot (YES in step 101), the banknote identifying machine reads the inserted banknote by the transmission photosensors 61 and other unshown various types of sensors (a magnetic sensor, etc.) (step 102). Here, signal data output from the respective transmission photosensors 61*a* to 61*c* are stored in respective prescribed regions in the memory 62. For a simplified description, an identifying process based on extracted data by a single photosensor will be described below.

First, the banknote identifying machine determines a denomination and inserted direction of the inserted banknote based on the extracted data by the various transmission photosensors 61 and other unshown sensors (step 103). If the denomination or the inserted direction cannot be determined (NO in step 104), the pertinent banknote is judged as counterfeit banknote, and the process is terminated (step 108).

When the inserted banknote can be determined its denomination and inserted direction in the step 103 (YES in step 104), an authenticity judging process is performed by the authenticity judging section 65 (step 105). The authenticity judging process will be described in detail later.

When the inserted banknote is determined as authentic banknote as a result of the authenticity judging process in the step 105 (YES in step 106), it is accepted by the banknote reception unit 4 (step 107), but when the inserted banknote is determined as counterfeit banknote (NO in step 106), the banknote is sent back by the banknote conveying unit 3 to return to the banknote insertion unit 2 (step 108).

Figure 5:
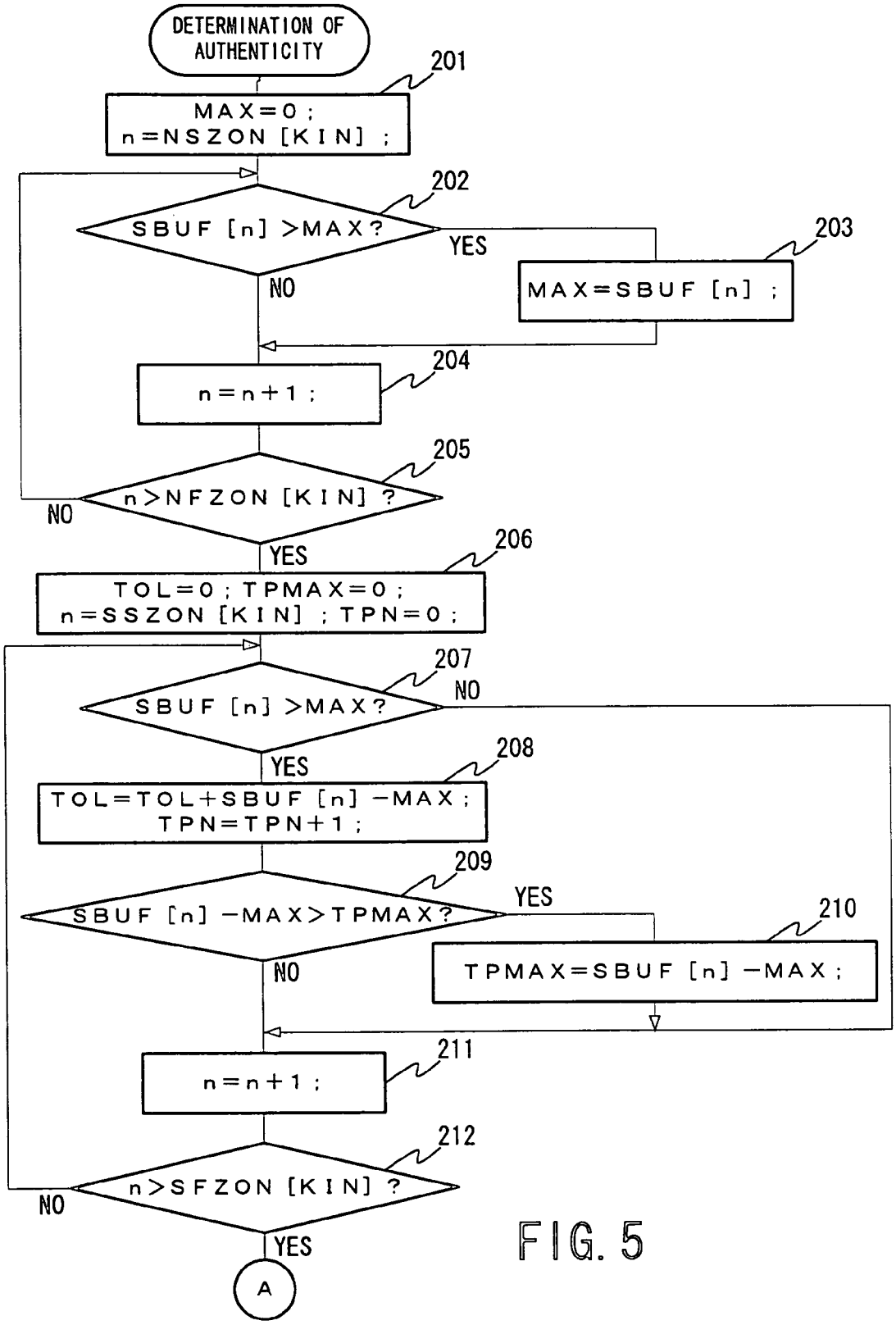
FIG. 5 is a flow chart illustrating a banknote identifying process by the identification unit shown in FIG. 1.
Figure 6:
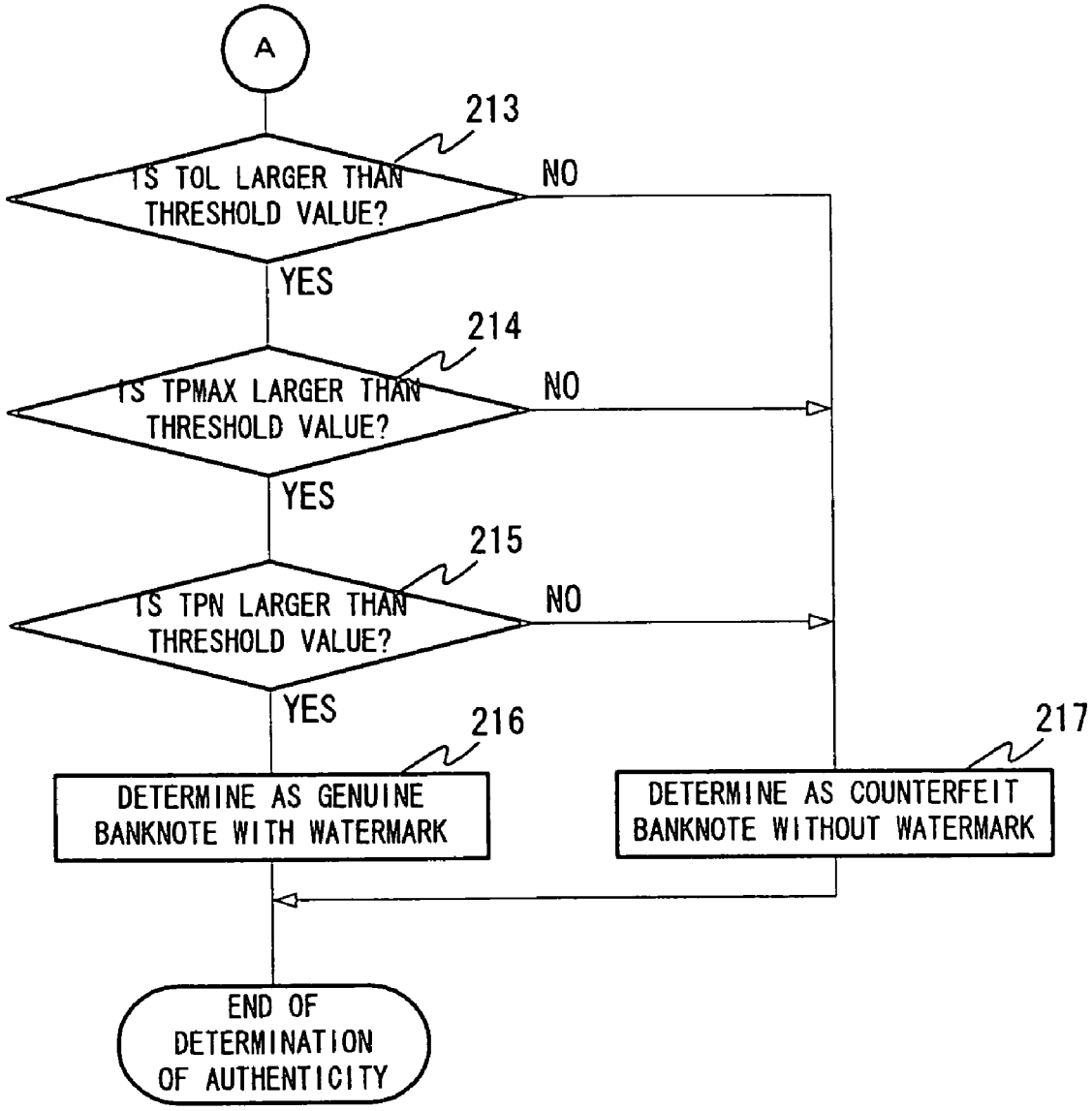
FIG. 6 is a flow chart illustrating the banknote identifying process by the identification unit shown in FIG. 1.

FIG. 5 and FIG. 6 are flow charts showing in detail the authenticity judging process in the step 105 of FIG. 4.

The authenticity judging section 65 resets the reference transmission level MAX to the minimum value "0" and also retrieves a start-point address NSZON [KIN] of the storage region, in which data on the ordinary design portion must be stored, from the data storage location address storage section 64 based on the denomination and inserted direction judged in the step 103 and sets address number n by the address NSZON [KIN] (step 201). The KIN is an index which is determined according to a combination of the denomination and inserted direction of the inserted banknote judged in the step 103.

It is determined whether the value of data stored in a storage region SBUF [n] on the memory 62 specified by the present address number n is larger than the value of the reference transmission level MAX (step 202). When it is yes (YES in step 202), the value of data stored in the memory region SBUF [n] substitutes for the value of the reference transmission level MAX (step 203). Subsequently, the n is increased by one (step 204), and it is determined whether the n has become an end-point address NFZON [KIN] of the storage region in which the ordinary design portion is stored (step 205). If it has not become NFZON [KIN] (NO in step 205), the procedure returns to the step 202, and the process is repeated. Thus, the storage region SBUF [n] of the memory 62, in which data corresponding to the prescribed ordinary design portions are stored, is entirely checked for magnitudes of the values of the stored data, and a maximum value is determined as the reference transmission level MAX.

The value of a TOL indicating a total value of differences between the reference transmission level MAX, which was determined by the process up to the step 205, and the values of data indicating transmission levels higher than the reference transmission level MAX, the value of a quantity TPN of data indicating transmission levels higher than the reference transmission level MAX and the value of a maximum relative transmission level TPMAX which is obtained by relativizing the maximum transmission level in the watermark region by the reference transmission level MAX are reset to the minimum value "0". And, a start-point address SSZON of the storage region, in which data of the watermark region must be stored, is retrieved from the data storage location address storage section 64 based on the denomination and inserted direction of the inserted banknote, and the address number n is determined by the SSZON [KIN] (step 206). The relativization by the reference transmission level MAX is subtraction of the value of the reference transmission level MAX from the value of data to be relativized.

Then, it is determined whether the value of data stored in the storage region SBUF [n] of the memory 62 specified by the present n is larger than the value of the reference transmission level MAX (step 207). If it is yes (YES in step 207), the value of the maximum transmission level MAX is subtracted from the value to be stored in the storage region SBUF [n] of the memory 62 specified by the present n, and the obtained difference is added to the total value TOL (TOL=TOL+SBUF [n]−MAX), and also 1 is added to the TPN (step 208). Here, the subtraction "SBUF [n]−MAX" is calculation to convert data stored in the storage region SBUF [n] of the memory 62 into data of the relative value to the reference transmission level MAX, and the calculation "TOL=TOL+SBUF [n]−MAX" is to determine a total of the relative value data (namely, to determine an area of the shaded portions shown in FIG. 3(*b*) and FIG. 3(*c*)).

Subsequently, it is determined whether the relative value data is larger than the value of the maximum relative transmission level TPMAX (step 209). If it is yes (YES in step 209), the relative value data "SBUF [n]−MAX" substitutes for the maximum relative transmission level TPMAX (step 210). Subsequently, the n is increased by one (step 211), and it is determined whether the n has become the end-point address SFZON [KIN] of the storage region in which data of the watermark portion must be stored (step 212). And, if it has not become SFZON [KIN] (NO in step 212), the procedure returns to the step 207, and the process is repeated.

Thus, the storage region SBUF [n] of the memory 62, in which data corresponding to the watermark portion is stored, is thoroughly checked for the magnitudes of the stored data values to determine a maximum value, and this maximum value is relativized by the reference transmission level MAX and determined as the maximum relative transmission level TPMAX. And, a quantity TPN of data indicating values larger than the value of the reference transmission level MAX is counted, the values of data indicating the values larger than the value of the reference transmission level MAX are relativized by the reference transmission level MAX, and a total TOL of the relativized values is determined.

Lastly, the obtained total TOL of the relativized value data, the maximum transmission level TPMAX and the quantity TPN of data indicating the values larger than the value of the reference transmission level MAX are compared with a threshold value determined for each of them to determine whether the banknote has a watermark so to determine whether the banknote is authentic. In other words, in FIG. 6, when all of the total value TOL of the relative value data, the maximum transmission level TPMAX and the quantity TPN of data indicating the values larger than the value of the reference transmission level MAX are larger than the threshold value determined for each of them (YES in steps 213 to 215), it is judged that the banknote is authentic having a watermark (step 216), but if any of them is smaller than the threshold value (NO in any of steps 213 to 215), it is judged that the banknote is counterfeit and does not have a watermark (step 217). The threshold values determined for TOL, TPMAX and TPN are prescribed evaluation values previously determined in correspondence with the TOL, TPMAX and TPN. These evaluation values can be determined properly by, for example, totaling the TOL, TPMAX and TPN values on many authentic banknote and processing them statistically.

In the above embodiment, all of TOL, TPMAX and TPN are used to determine whether the banknote has a watermark, but only one or two of them may be used for judgment.

The above-described embodiment shows an example judgment of line data in synchronization with the movement of the banknote, but an area sensor may also be used to perform the same process.

And, the banknote authenticity judgment process in practice is not limited to the determination of authenticity by only the judging method according to the present invention, but it may be combined with another judging factor to make a final judgment.

INDUSTRIAL APPLICABILITY

The present invention provides a banknote identifying machine and banknote identifying method, which can stably determine the authenticity of banknote without being affected by a sensor or contamination on the banknote. According to the present invention, an amount of light transmitted through a watermark portion of the banknote is evaluated by an amount of light transmitted through the portions other than the watermark. In other words, the watermark portion and the other portions are subject to relative comparison, so that the banknote can be stably determined its authenticity without being affected by a sensor or contamination on the banknote. And, because the authenticity can be determined based on the quality (thickness) of the banknote, the accuracy of determining counterfeit banknote which is virtually distinguishable from the real one can be improved.

The invention claimed is:

1. A banknote identifying machine, comprising:

detecting means which scans a banknote being transported and irradiates light to the banknote to detect an amount of light transmitted through the banknote; and judging means which determines whether the banknote is authentic based on a relative value between an amount of transmitted light through a watermark portion of the banknote detected by the detecting means and an amount of transmitted light through ordinary design portions other than the watermark portion.

2. A banknote identifying machine, comprising:

a transmission photosensor which scans a banknote being transported and irradiates light to the banknote to detect an amount of transmitted light through the banknote;

data storage means which stores data output from the transmission photosensor by allocating serial addresses to the data;

storage location address storage means which previously stores addresses of storage regions of the data storage means in which data output according to a watermark portion of the banknote is to be stored; and authenticity judging means which determines the authenticity of the banknote based on a relative value between data stored in the storage regions of the storage means designated by the addresses stored in the storage location address storage means and data corresponding to portions other than the watermark.

3. The banknote identifying machine according to claim 2, further comprising determination means which determines a denomination of the banknote, wherein:

the storage location address storage means previously stores the addresses of storage regions of the data storage means, in which the data output according to the watermark portion of the banknote is to be stored, according to the denomination of the banknote; and the authenticity judging means obtains addresses, which are stored in association with the denomination determined by the determination means, from the storage location address storage means, and determines the authenticity of the banknote based on a relative value between the data, which is stored in the storage regions of the data storage means designated by the obtained addresses, and data on a maximum value among the data corresponding to the portions other than the watermark.

4. The banknote identifying machine according to claim 2, further comprising determination means, which determines an inserted direction of the banknote, wherein:

the storage location address storage means previously stores the addresses of storage regions of the data storage means, in which data output according to the watermark portion of the banknote is to be stored, according to the inserted direction of the banknote; and the authenticity judging means obtains addresses, which are stored in association with the inserted direction determined by the determination means, from the storage location address storage means, and determines the authenticity of the banknote based on a relative value between the data, which is stored in the storage regions of the data storage means designated by the obtained addresses, and data on a maximum value among the data corresponding to the portions other than the watermark.

5. The banknote identifying machine according to claim 2, further comprising determination means which determines a denomination and an inserted direction of the banknote, wherein:

the storage location address storage means previously stores the addresses of storage regions of the data storage means, in which data output according to the watermark portion of the banknote is to be stored, according to the denomination and the inserted direction of the banknote; and the authenticity judging means obtains addresses, which are stored in association with the denomination and the inserted direction determined by the determination means, from the storage location address storage means, and determines the authenticity of the banknote based on a relative value between the data, which is stored in the storage region of the data storage means designated by the obtained addresses, and data on a maximum value among the data corresponding to the portions other than the watermark.

6. The banknote identifying machine according to claim 2, wherein the authenticity judging means determines the presence or not of the watermark on the banknote according to a difference between data on the maximum value output according to the watermark portion and data on the maximum value output according to the portions other than the watermark.

7. The banknote identifying machine according to claim 2, wherein the authenticity judging means counts a quantity of data which is output according to the watermark portion and larger than the data on the maximum value output according to the portions other than the watermark and determines the presence or not of a watermark on the banknote according to the counted quantity.

8. The banknote identifying machine according to claim 2, wherein the authenticity judging means determines the presence or not of the watermark on the banknote according to a total value of differences between data which is output according to the watermark portion and larger than data on the maximum value output according to the portions other than the watermark and data on the maximum value output according to the portions other than the watermark.

9. A banknote identifying method, comprising:

scanning a banknote being transported, detecting an amount of transmitted light though the banknote by irradiating light to the banknote, and determining the authenticity of the banknote based on a relative value between an amount of transmitted light, which is detected from a watermark portion of the banknote, and a maximum value of an amount of transmitted light, which is detected from an ordinary design portion other than the watermark.

* * * * *